US011016416B2

(12) United States Patent
Ajima et al.

(10) Patent No.: US 11,016,416 B2
(45) Date of Patent: May 25, 2021

(54) IMAGE FORMING APPARATUS AND DEVELOPER CONTAINER

(71) Applicant: TOSHIBA TEC KABUSHIKI KAISHA, Tokyo (JP)

(72) Inventors: Hisanobu Ajima, Yokohama Kanagawa (JP); Nobuo Tohata, Sunto Shizuoka (JP); Yuichiro Takeda, Fuji Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/544,542

(22) Filed: Aug. 19, 2019

(65) Prior Publication Data

US 2020/0249593 A1 Aug. 6, 2020

(30) Foreign Application Priority Data

Feb. 6, 2019 (JP) ..... JP2019-020062

(51) Int. Cl.
*G03G 15/08* (2006.01)
*G03G 21/20* (2006.01)

(52) U.S. Cl.
CPC ..... *G03G 15/0891* (2013.01); *G03G 15/0808* (2013.01); *G03G 15/0848* (2013.01);
(Continued)

(58) Field of Classification Search
CPC ..... G03G 15/822; G03G 15/863; G03G 21/1875; G03G 21/1889
See application file for complete search history.

(56) References Cited

U.S. PATENT DOCUMENTS 5,184,181 A 2/1993 Kurando et al.
8,331,807 B2 12/2012 Homma et al.
(Continued)

FOREIGN PATENT DOCUMENTS

JP 06-149051 A 5/1994
JP 2009134278 A * 6/2009

OTHER PUBLICATIONS

Machine translation of JP2009134278 (Year: 2009).*
Extended European Search report issued in European Patent Application No. 19209276.5 dated Jun. 22, 2020, eight (8) pages.

*Primary Examiner* — Walter L Lindsay, Jr.
*Assistant Examiner* — Andrew V Do
(74) *Attorney, Agent, or Firm* — Foley & Lardner LLP

(57) ABSTRACT

According to one embodiment, an image forming apparatus includes a developing device, a sensor, a control information obtaining unit, and a control unit. The developing device forms an image on an image carrier using a developer. The sensor generates a signal indicating a measurement value related to the developer. The control information obtaining unit obtains, as control information of the developing device, one or more pieces of the control information pre-associated with the measurement value, from a recording medium associated with the developer. The control unit selects the control information associated with the measurement value indicated by the signal, from the one or more pieces of control information obtained from the recording medium. The control unit controls an operation of the developing device based on the selected control information.

13 Claims, 10 Drawing Sheets

(52) U.S. Cl.
CPC ..... *G03G 15/0863* (2013.01); *G03G 21/20* (2013.01); *G03G 2215/0697* (2013.01)

(56) References Cited

U.S. PATENT DOCUMENTS

| | | | | |
|---|---|---|---|---|
| 10,146,178 | B2 | 12/2018 | Murata et al. | |
| 2006/0291878 | A1* | 12/2006 | Shishikura ..... | G03G 15/0121 399/27 |
| 2008/0181638 | A1* | 7/2008 | Fujioka ..... | G03G 15/0893 399/58 |
| 2011/0318022 | A1* | 12/2011 | Ajima ..... | G03G 15/0865 399/12 |
| 2014/0233967 | A1 | 8/2014 | Suzuki | |

* cited by examiner

FIG. 3

| ADDRESS | INFORMATION CONTENT |
|---|---|
| A001 | IDENTIFICATION INFORMATION |
| A002 | CONTROL INFORMATION (FIRST TEMPERATURE CATEGORY) |
| A003 | CONTROL INFORMATION (SECOND TEMPERATURE CATEGORY) |
| A004 | CONTROL INFORMATION (THIRD TEMPERATURE CATEGORY) |
| A005 | CONTROL INFORMATION (FOURTH TEMPERATURE CATEGORY) |
| A006 | CONTROL INFORMATION (FIFTH TEMPERATURE CATEGORY) |

FIG. 4

| ADDRESS | INFORMATION CONTENT |
|---|---|
| B001 | IDENTIFICATION INFORMATION |
| B002 | CONTROL INFORMATION (FIRST TEMPERATURE CATEGORY) |
| B003 | CONTROL INFORMATION (SECOND TEMPERATURE CATEGORY) |
| B004 | CONTROL INFORMATION (THIRD TEMPERATURE CATEGORY) |
| B005 | CONTROL INFORMATION (FOURTH TEMPERATURE CATEGORY) |
| B006 | CONTROL INFORMATION (FIFTH TEMPERATURE CATEGORY) |

FIG. 5

| TEMPERATURE OF DEVELOPING DEVICE | | FINE POWDER (SMALL) | FINE POWDER (NORMAL) | FINE POWDER (LARGE) |
|---|---|---|---|---|
| FIRST TEMPERATURE CATEGORY | ≤40℃ | 1 | 1 | 1 |
| SECOND TEMPERATURE CATEGORY | 40.1~42℃ | 1 | 1 | 2 |
| THIRD TEMPERATURE CATEGORY | 42.1~44℃ | 1 | 2 | 3 |
| FOURTH TEMPERATURE CATEGORY | 44.1~46℃ | 1 | 2 | 4 |
| FIFTH TEMPERATURE CATEGORY | 46.1℃≤ | 2 | 3 | 4 |

FIG. 7

| TEMPERATURE OF DEVELOPING DEVICE | | DISPERSION COEFFICIENT (SMALL) | DISPERSION COEFFICIENT (NORMAL) | DISPERSION COEFFICIENT (LARGE) |
|---|---|---|---|---|
| FIRST TEMPERATURE CATEGORY | ≤40°C | 1 | 1 | 1 |
| SECOND TEMPERATURE CATEGORY | 40.1~42°C | 1 | 1 | 2 |
| THIRD TEMPERATURE CATEGORY | 42.1~44°C | 1 | 2 | 3 |
| FOURTH TEMPERATURE CATEGORY | 44.1~46°C | 1 | 2 | 4 |
| FIFTH TEMPERATURE CATEGORY | 46.1°C≤ | 2 | 3 | 4 |

FIG. 9

| ADDRESS | INFORMATION CONTENT |
|---|---|
| A001 | IDENTIFICATION INFORMATION |
| A002 | MANUFACTURING DATE INFORMATION |
| A003 | CONTROL INFORMATION (FIRST TEMPERATURE CATEGORY) |
| A004 | CONTROL INFORMATION (SECOND TEMPERATURE CATEGORY) |
| A005 | CONTROL INFORMATION (THIRD TEMPERATURE CATEGORY) |
| A006 | CONTROL INFORMATION (FOURTH TEMPERATURE CATEGORY) |
| A007 | CONTROL INFORMATION (FIFTH TEMPERATURE CATEGORY) |

FIG. 10

| ADDRESS | INFORMATION CONTENT |
|---|---|
| B001 | IDENTIFICATION INFORMATION |
| B002 | MANUFACTURING DATE INFORMATION |
| B003 | CONTROL INFORMATION (FIRST TEMPERATURE CATEGORY) |
| B004 | CONTROL INFORMATION (SECOND TEMPERATURE CATEGORY) |
| B005 | CONTROL INFORMATION (THIRD TEMPERATURE CATEGORY) |
| B006 | CONTROL INFORMATION (FOURTH TEMPERATURE CATEGORY) |
| B007 | CONTROL INFORMATION (FIFTH TEMPERATURE CATEGORY) |

| TEMPERATURE OF DEVELOPING DEVICE | | Tg (LOW) 30.0~34.0 | Tg (NORMAL) 34.1~40.0 | Tg (HIGH) 40.1~45.0 |
|---|---|---|---|---|
| FIRST TEMPERATURE CATEGORY | ≤40°C | 1 | 1 | 1 |
| SECOND TEMPERATURE CATEGORY | 40.1~42°C | 2 | 1 | 1 |
| THIRD TEMPERATURE CATEGORY | 42.1~44°C | 3 | 2 | 1 |
| FOURTH TEMPERATURE CATEGORY | 44.1~46°C | 4 | 2 | 1 |
| FIFTH TEMPERATURE CATEGORY | 46.1°C≤ | 4 | 3 | 2 |

| | NUMBER OF ELAPSED DAYS | Tg CORRECTION VALUE |
|---|---|---|
| FIRST ELAPSED DAY CATEGORY | 0~180 DAYS | 0°C |
| SECOND ELAPSED DAY CATEGORY | 181~300 DAYS | +3°C |
| THIRD ELAPSED DAY CATEGORY | 301 DAYS~ | +5°C |

IMAGE FORMING APPARATUS AND DEVELOPER CONTAINER

CROSS-REFERENCE TO RELATED APPLICATION

This application is based upon and claims the benefit of priority from Japanese Patent Application No. 2019-020062, filed Feb. 6, 2019, the entire contents of which are incorporated herein by reference.

FIELD

Embodiments described herein relate generally to an image forming apparatus and a developer container.

BACKGROUND

An image forming apparatus performs a printing operation by using a developer, such as toner or the like. Since a transport characteristic of the developer is easily affected by heat, a transport failure of the developer may occur when a temperature inside the image forming apparatus is equal to or higher than a certain level. In order to prevent the transport failure of the developer from occurring, the image forming apparatus limits the printing operation when the temperature inside the image forming apparatus is equal to or higher than the certain level. However, there were cases where a time during which the printing operation is limited is longer than necessary.

DESCRIPTION OF THE DRAWINGS

FIG. 3 is a diagram showing an arrangement example of information in a memory;

FIG. 4 is a diagram showing an arrangement example of information in a memory of a cartridge;

FIG. 5 is a diagram showing an example of a relationship between control information and a temperature of a developing device for each amount of fine powder of a developer;

FIG. 7 is a diagram showing an example of a relationship between control information and a temperature of a developing device for each dispersion coefficient according to a second embodiment;

FIG. 9 is a diagram showing an arrangement example of information in a memory;

FIG. 10 is a diagram showing an arrangement example of information in a memory of a cartridge;

DETAILED DESCRIPTION

Embodiments provide an image forming apparatus and a developer container which enable a time during which a printing operation is limited to be not increased longer than necessary.

In general, according to one embodiment, an image forming apparatus includes a developing device, a sensor, a control information obtaining unit, and a control unit. The developing device is configured to form an image on an image carrier by using a developer. The sensor is configured to generate a signal indicating a measurement value related to the developer. The control information obtaining unit is configured to obtain, as control information of the developing device, one or more pieces of the control information pre-associated with the measurement value, from a recording medium associated with the developer. The control unit is configured to select the control information associated with the measurement value indicated by the signal, from the one or more pieces of control information obtained from the recording medium. The control unit is further configured to control an operation of the developing device based on the selected control information.

Hereinafter, an image forming apparatus and a developer container according to embodiments will be described with reference to the drawings.

First Embodiment

Figure 1:
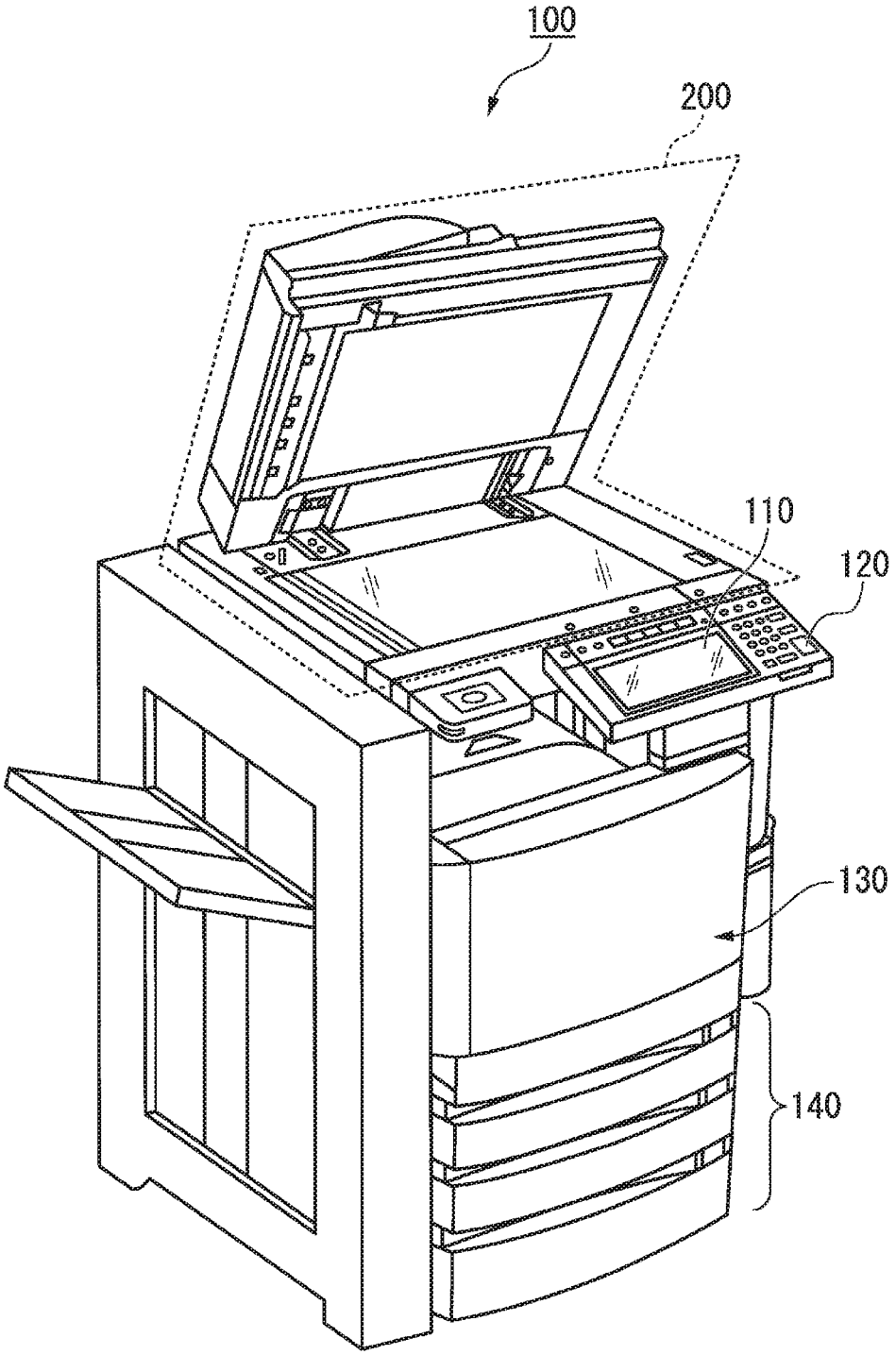
FIG. 1 is an external view showing an overall configuration example of an image forming apparatus, according to a first embodiment.

FIG. 1 is an external view showing an overall configuration example of an image forming apparatus 100, according to an embodiment. The image forming apparatus 100 is, for example, a multifunction peripheral. The image forming apparatus 100 includes a display 110, a control panel 120, a printer 130, a sheet accommodating unit 140, and an image reading unit 200.

The image forming apparatus 100 forms an image on a sheet by using a developer such as toner or the like. The sheet is, for example, a piece of paper or a label. The sheet is not limited as long as the image forming apparatus 100 is able to form an image on a surface thereof.

The display 110 is an image display apparatus, such as a liquid crystal display, an organic electroluminescence (EL) display, or the like. The display 110 displays various types of information about the image forming apparatus 100. The various types of information are, for example, information indicating the number of sheets on which an image is formed.

The control panel 120 includes a plurality of buttons. The control panel 120 receives an operation of a user. The control panel 120 outputs a signal corresponding to the operation performed by the user to a control unit of the image forming apparatus 100. The display 110 and the control panel 120 may be configured as an integral touch panel.

The printer 130 forms an image on a sheet, based on image information generated by the image reading unit 200. The printer 130 may form an image on a sheet, based on image information (online data) received via a communication path. A sheet where an image is formed may be a sheet accommodated in the sheet accommodating unit 140 or a sheet manually inserted into the image forming apparatus 100.

The sheet accommodating unit 140 accommodates a sheet used to form an image by the printer 130. The image reading unit 200 (scanner) reads image information of a reading target, based on brightness of light of the reading target. The image reading unit 200 outputs the read image information to the printer 130. An image corresponding to the recorded image information is formed on a sheet by the printer 130. The image reading unit 200 may output the read image information to another information processing apparatus via a network.

Figure 2:
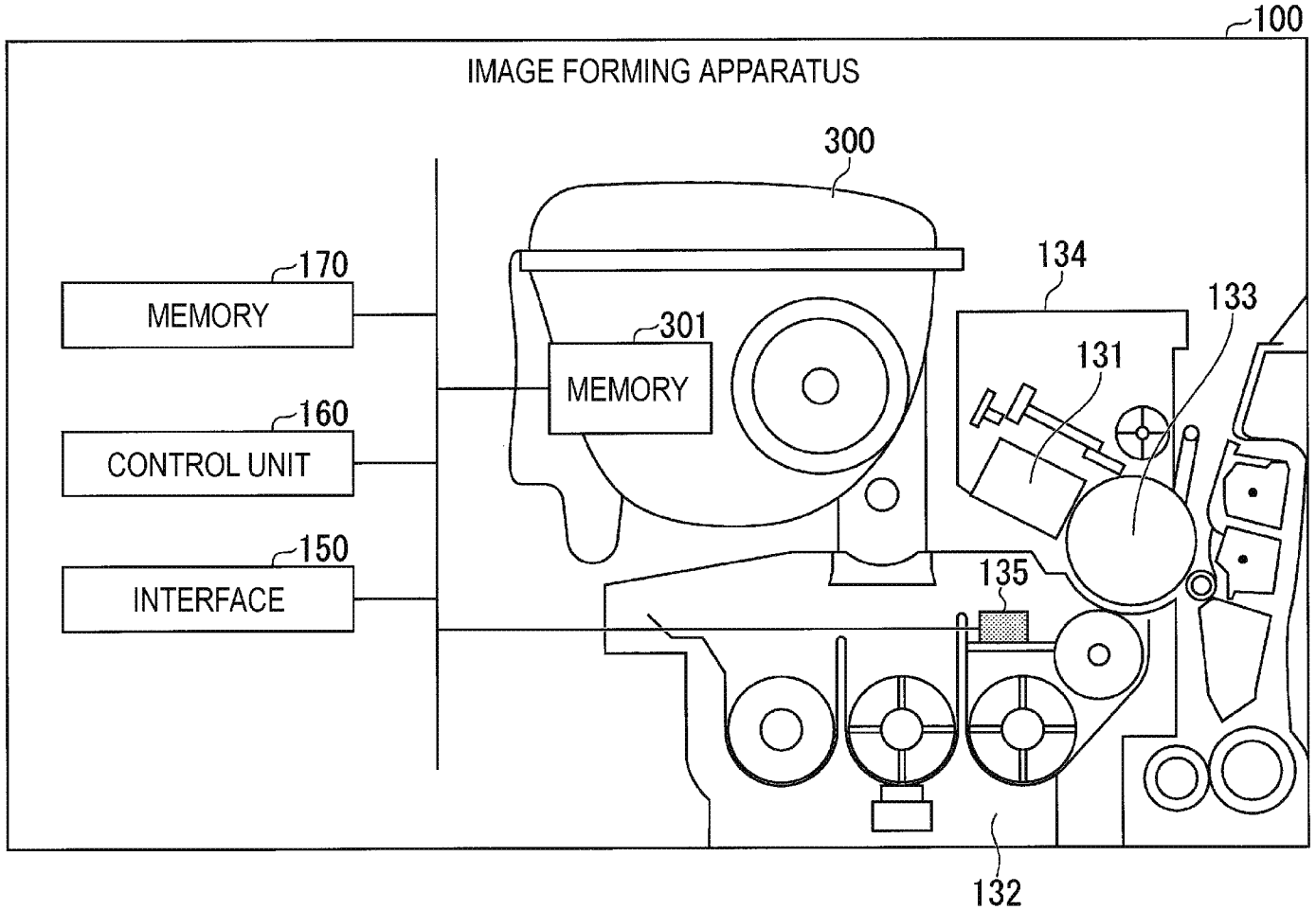
FIG. 2 is a block diagram showing a configuration example of the image forming apparatus.

FIG. 2 is a block diagram showing a configuration example of the image forming apparatus 100. The image forming apparatus 100 includes a charging device 131, a developing device 132, a photosensitive drum 133, a cleaning device 134, a sensor 135, and the printer 130.

The charging device 131 forms an electrostatic latent image on the photosensitive drum 133, based on image information. The developing device 132 forms a visible image by attaching a developer to the electrostatic latent image. The developer is, for example, toner. The photosensitive drum 133 transfers the visible image onto a sheet. A fixing device of the printer 130 fixes the transferred visible image on the sheet by heating and pressuring the sheet. The cleaning device 134 removes the developer remaining without being transferred from the photosensitive drum 133. The sensor 135 measures a temperature of the developing device 132 as a temperature of the developer. The sensor 135 may measure humidity around the developing device 132 as humidity of the developer.

In the image forming apparatus 100, a cartridge 300 (developer container) in which the developer is accommodated is attachably or detachably provided. The cartridge 300 includes a memory 301. The memory 301 is, for example, a non-volatile recording medium (non-transitory recording medium), such as a flash memory or the like. The memory 301 stores, for example, a data table. The data table includes one or more pieces of control information associated with a measurement value of a temperature or the like for each physical amount related to the developer. The physical amount related to the developer is, for example, a particle size distribution of the developer, a volume average particle size of the developer, and a storage characteristic of the developer.

The image forming apparatus 100 includes an interface 150, a control unit 160, and a memory 170. The interface 150 (control information obtaining unit) transmits identification information stored in the memory 301 to the control unit 160 when the cartridge 300 is provided in the image forming apparatus 100. For example, when a front cover of the printer 130 is opened or closed, the interface 150 transmits the identification information to the control unit 160. The interface 150 records each piece of control information stored in the memory 301, on the memory 170 in response to control by the control unit 160.

The control unit 160 controls operations of each functional unit of the image forming apparatus 100. Part or the entirety of the control unit 160 is realized as software as a processor, such as a central processing unit (CPU) or the like, and executes a program stored in the memory 170. The part or entirety of the control unit 160 may be realized, for example, by using hardware such as large scale integration (LSI), or the like.

The memory 170 is, for example, a non-volatile recording medium (non-transitory recording medium) such as a flash memory or the like. The memory 170 stores, for example, a program or a data table. The memory 170 may include, for example, a volatile recording medium such as a dynamic random access memory (DRAM) or the like.

FIG. 3 is a diagram showing an arrangement example of information in the memory 170 of the image forming apparatus 100. In the memory 170, a plurality of addresses (storage areas) is defined. In FIG. 3, as an example, a plurality of addresses from "A001" to "A006" is defined in the memory 170. Pre-determined identification information is stored in the address "A001". Control information (operation specification information) stored in the memory 301 is stored in the plurality of addresses from "A002" to "A006" for each temperature category (a category of measurement values). The control information is expressed by, for example, a value from "1" to "4". The interface 150 records each piece of control information stored in the memory 301, in the memory 170 in response to control by the control unit 160, when power on, front cover open or close, or the like of the image forming apparatus 100 is detected.

FIG. 4 is a diagram showing an arrangement example of information in the memory 301 of the cartridge 300. In the memory 301, a plurality of addresses (storage areas) is defined. In FIG. 4, as an example, a plurality of addresses from "B001" to "B006" is defined in the memory 301. In the address "B001", for example, the same identification information as the identification information stored in the memory 170 is stored. In the plurality of addresses from "B002" to "B006", control information is stored for each temperature category. Each piece of control information is pre-determined based on a particle size distribution (proportion of fine powder) of the developer of the cartridge 300, as operation specification information corresponding to a detected temperature (measurement value). A physical amount such as the particle size distribution or the like of the developer is measured for each production lot of the developer of the cartridge 300.

FIG. 5 is a diagram showing an example of a relationship between control information and a temperature (measurement value) of the developing device 132 for each amount (physical amount) of fine powder of a developer. A first temperature category is, for example, a temperature category of 40° C. or lower (low temperature) of the developing device 132. A second temperature category is, for example, a temperature category in a range of 40.1 to 42° C. of the developing device 132. A third temperature category is, for example, a temperature category in a range of 42.1 to 44° C. of the developing device 132. A fourth temperature category is, for example, a temperature category in a range of 44.1 to 46° C. of the developing device 132. A fifth temperature category is, for example, a temperature category of 46.1° C. or higher (high temperature) of the developing device 132. The number of temperature categories may be increased or decreased as required. Control information of each temperature category is stored in the memory 301 of the cartridge 300 according to proportions of fine powder measured for each production lot of the developer of the cartridge 300.

The proportion of fine powder in a particle size distribution of the developer is classified into fine powder "small", fine powder "normal", and fine powder "large". The number of categories of the proportion of fine powder may be increased or decreased as required. The proportion of fine powder of the developer is small when, for example, a proportion of a particle size of 3.17 μm (Pop) is, for example, in a range of 0 to 2.5%, with respect to a particle size distribution of the developer of which a volume average particle size "D50" (Vol) is, for example, 8 μm. For example, when the proportion of the particle size of 3.17 μm (Pop) is, for example, in a range of 2.6 to 5.0%, the proportion of fine powder of the developer is normal (ordinary). For example, when the proportion of the particle size of 3.17 μm (Pop) is, for example, 5.1% or higher, the proportion of fine powder of the developer is large. One of pieces of control information "1" to "4" is recorded in the memory 301 for each proportion of fine powder of the developer in the cartridge 300.

The control information "1" indicates an operation specification that the image forming apparatus 100 performs a print job.

The control information "2" indicates an operation specification that the control unit 160 reverses a rotation direction of a magnet roller for conveying the developer in the developing device 132.

The control information "3" indicates an operation specification that the control unit 160 sets a rotation speed of the magnet roller to a low speed until a temperature of the developing device 132 is decreased to a predetermined temperature. For example, the control unit 160 sets the rotation speed of the magnet roller to a predetermined low speed until the temperature of the developing device 132 is decreased from the third temperature category to the second temperature category.

The control information "4" indicates an operation specification that the image forming apparatus 100 stops the performing of the print job.

The control unit 160 selects control information associated with the temperature of the developing device 132 from among a plurality of pieces of control information stored in the memory 170. For example, when each piece of control information of proportion "fine powder (large)" of fine powder is stored in the memory 170 and the temperature of the developing device 132 belongs to the first temperature category, the control unit 160 selects the control information "1" associated with the first temperature category. The control unit 160 controls an operation of the developing device 132 based on control information. When the control information "1" is selected, the control unit 160 performs the print job without having to stop (limit) the performing of the print job.

For example, when each piece of control information of proportion "fine powder (large)" of fine powder is stored in the memory 170 and the temperature of the developing device 132 belongs to the second temperature category, the control unit 160 selects the control information "2" associated with the second temperature category. The control unit 160 reversely rotates a rotation phase of the magnet roller by, for example, only 45°, with respect to a current rotation phase. As a result, the control unit 160 may release the developer present near a doctor blade of the developing device 132.

For example, when each piece of control information of proportion "fine powder (large)" of fine powder is stored in the memory 170 and the temperature of the developing device 132 belongs to the third temperature category, the control unit 160 selects the control information "3" associated with the third temperature category. The control unit 160 sets the rotation speed of the magnet roller to a low speed until the temperature of the developing device 132 is decreased from the third temperature category to the second temperature category, after the print job is completed. For example, the control unit 160 rotates the magnet roller at a process speed "100 mm/s" that is a low speed relative to a process speed "209 mm/s" when the print job is performed.

For example, when each piece of control information of proportion "fine powder (large)" of fine powder is stored in the memory 170 and the temperature of the developing device 132 belongs to the fourth temperature category, the control unit 160 selects the control information "4" associated with the fourth temperature category. The control unit 160 stops the performing of the print job. The control unit 160 displays a message such as "please wait for a while" on the control panel 120. The control unit 160 may not receive a command instructing to perform the print job until the temperature of the developing device 132 is decreased from the fourth temperature category to the third temperature category. On the other hand, for example, when each piece of control information of proportion "fine powder (small)" of fine powder is stored in the memory 170 and the temperature of the developing device 132 belongs to the fourth temperature category, the control unit 160 selects the control information "1" associated with the fourth temperature category. Since the control information "1" is selected, the control unit 160 performs the print job without having to stop (limit) the performing of the print job.

The data table shown in FIG. 5 may be pre-stored in the memory 170. When the data table shown in FIG. 5 is pre-stored in the memory 170, the memory 301 may store information indicating categories of the proportion of fine powder, such as "fine powder (small)", and the like, and may not store each piece of control information. The control unit 160 may control an operation of the developing device 132, based on the data table pre-stored in the memory 170, the temperature of the developing device 132, and the information indicating the categories of the proportion of fine powder, which is stored in the memory 301.

Next, an operation example of the image forming apparatus 100 will be described.

Figure 6:
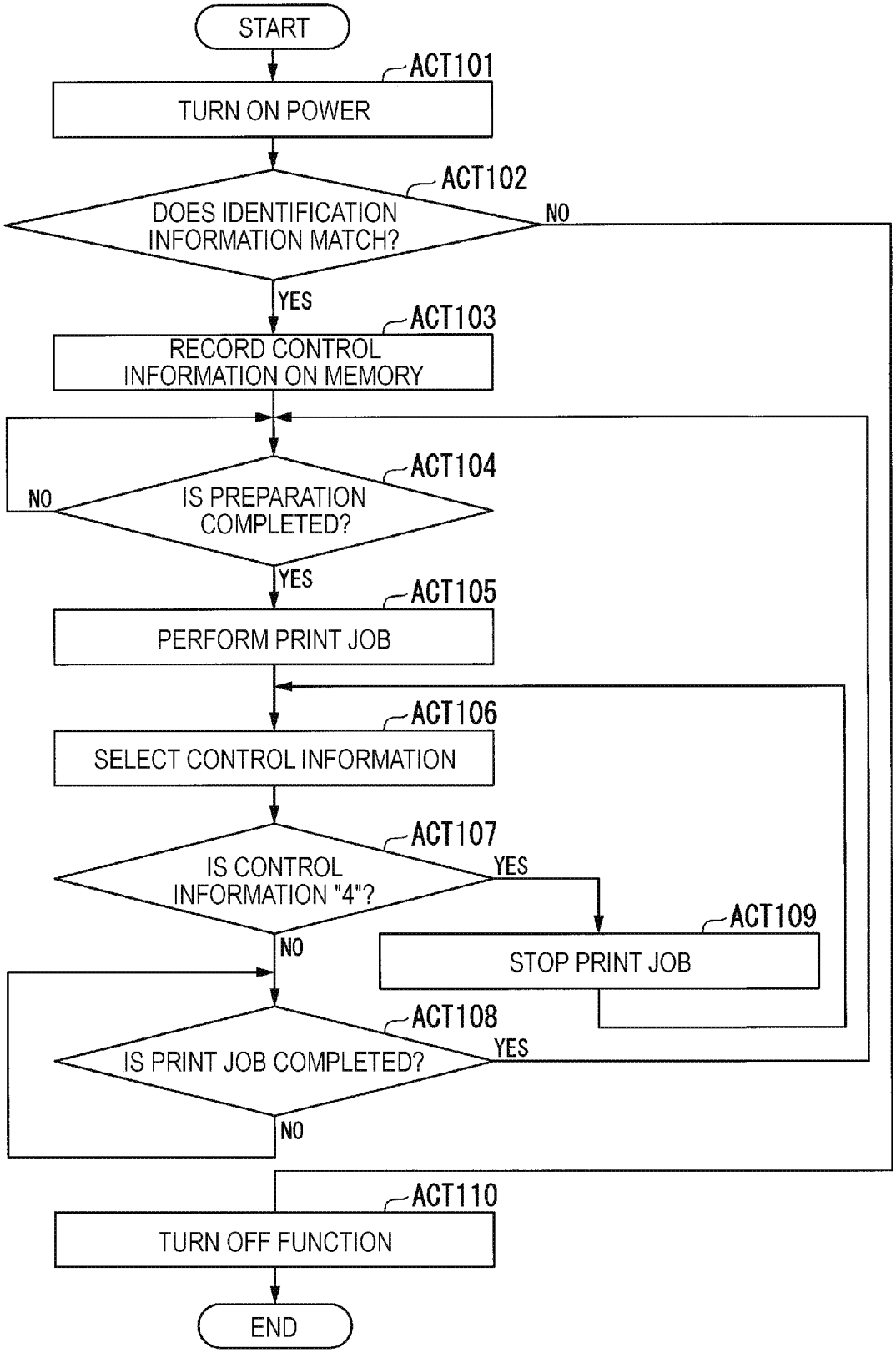
FIG. 6 is a flowchart of an operation example of the image forming apparatus.

FIG. 6 is a flowchart of an operation example of the image forming apparatus 100. When a predetermined condition is satisfied, the interface 150 transmits identification information stored in the memory 301 of the cartridge 300 to the control unit 160. The predetermined condition is, for example, that any one of power on of the image forming apparatus 100, warming-up start (return from a sleep state) of the image forming apparatus 100, and opening or closing of a front cover of the printer 130 is detected. The interface 150 transmits identification information stored in the memory 170 of the image forming apparatus 100 to the control unit 160. Instead of the interface 150 transmitting the identification information stored in the memory 170 to the control unit 160, the control unit 160 may access the memory 170 and obtain the identification information from the memory 170 (ACT 101).

The control unit 160 determines whether identification information of the address "A001" of the memory 170 and identification information of the address "B001" of the memory 301 match (ACT 102). When the identification information of the address "A001" and the identification information of the address "B001" match (ACT 102: YES), the interface 150 records each piece of control information stored in the memory 301, on the memory 170, in response to control by the control unit 160 (ACT 103).

The control unit 160 determines whether preparation for performing a print job is completed (ACT 104). The control unit 160 performs a predetermined print job (ACT 105). The control unit 160 obtains a result of detecting a temperature of the developing device 132. The control unit 160 selects control information pre-associated with the temperature (measurement value) detected by the sensor 135, from among a plurality of pieces of control information stored in the memory 170 (ACT 106). The control unit 160 determines whether the selected control information is "4" (ACT 107).

When the selected control information is other than "4" (ACT 107: NO), the control unit 160 determines whether the performing of the predetermined print job is completed (ACT 108). When the performing of the print job is not completed (ACT 108: NO), the control unit 160 continues to perform the print job. When the performing of the print job is completed (ACT 108: YES), the control unit 160 performs a process of ACT 104.

When the identification information of the address "A001" and the identification information of the address "B001" do not match (ACT 102: NO), the control unit 160 turns off a function of controlling an operation of the developing device, based on the control information associated with the temperature. The control unit 160 performs the print job in an operation mode in which the function is turned off. As a result, the control unit 160 is able to prevent malfunction from occurring according to control information stored in the memory 301, even when the cartridge 300 that is not authorized is provided in the image forming apparatus 100 (ACT 110).

As described above, the image forming apparatus 100 according to the first embodiment includes the developing device 132, the sensor 135, the interface 150 (control information obtaining unit), and the control unit 160. The developing device 132 forms an image on an image carrier such as the photosensitive drum 133 or the like by using a developer. The sensor 135 generates a signal indicating a measurement value related to the developer. The measurement value related to the developer is, for example, a temperature or humidity. The interface 150 obtains one or more pieces of control information associated with the measurement value from the memory 301 associated with the developer, as control information of the developing device 132. The control information is determined for each particle size distribution, volume average particle size, storage characteristic, or a wax amount of the developer. The control unit 160 selects the control information pre-associated with the measurement value indicated by the signal of the sensor 135, from among the one or more pieces of control information obtained from the memory 301. The control unit 160 controls an operation of the developing device 132, based on the selected control information. Accordingly, it is possible to prevent a time during which a printing operation is limited from being increased longer than necessary.

When the memory 301 is not provided in the cartridge 300, a temperature characteristic of the developer of the cartridge 300 is not clear. Accordingly, when the temperature of the developing device 132 reaches a predetermined temperature (a temperature of the fourth temperature category), the image forming apparatus 100 needs to stop the performing of the print job, based on each piece of control information of "fine powder (large)" so as to prevent transport failure of the developer. In this regard, in the first embodiment, when the temperature of the developing device 132 does not reach a temperature determined for each production lot of the developer of the cartridge 300, the image forming apparatus 100 may not deliberately stop the performing of the print job. Accordingly, it is possible for the image forming apparatus 100 to reduce a possibility in which a waiting time of the print job is increased. It is possible for the image forming apparatus 100 to reduce a possibility in which productivity of printing is decreased.

It is easier to deal with the increase in a lineup of the developer when a data table of the control information is stored in the memory 301 of the cartridge 300 than when the data table of the control information is pre-stored in the memory 170 of the image forming apparatus 100.

Instead of the temperature category shown in FIGS. 3, 4, and 5, a humidity category may be defined. Instead of the categories of proportion of the fine powder shown in FIG. 5, control information may be defined for each of at least one category (toner or parameter) from among a thermal characteristic (a softening point temperature or a melting point temperature Tm) of the developer, a flow characteristic (adhesion strength with an external additive) of the developer, a storage characteristic (settability or storage stability) of the developer, and an amount of wax in the developer. The higher the softening point temperature of the developer, the higher the transport characteristic of the developer. The higher the adhesion strength with the external additive, the higher the transport characteristic of the developer. In other words, when the adhesion strength of the external additive is higher, blocking of the developer during transport is less likely to occur, and thus the transport characteristic of the developer is higher. An indicator of the storage characteristic is expressed by using a ratio of a fixed amount of the developer to an amount of the developer left on a sieve when the fixed amount of the developer is sieved. When the indicator of the storage characteristic is not satisfactory, the developer tends to set, and thus the amount of developer left on the sieve is large compared to when the indicator of the storage characteristic is satisfactory. The indicator of the storage characteristic may be measured by an acceleration test in an environment in which a temperature is higher than the room temperature. The higher the amount of wax in the developer, the lower the transport characteristic of the developer. In other words, when the amount of wax in the developer is larger, blocking of the developer is more likely to occur.

Second Embodiment

A second embodiment is different from the first embodiment in that temperature category and control information are associated with each dispersion coefficient of wax of a developer. In the second embodiment, differences from the first embodiment will be described.

A wax dispersion coefficient is an indicator indicating a wax dispersion state (a distribution property of wax) of a developer. The higher the wax dispersion coefficient, the easier it is for a transport failure of the developer to occur. The wax dispersion coefficient is expressed as Equation 1.

$$\text{Wax Dispersion Coefficient} = (\text{Wax Heat Quantity [J/g] of Classified Fine Powder})/(\text{Wax Heat Quantity [J/g] of Product}) \quad (1)$$

Here, the product is a developer included in the cartridge 300. The classified fine powder is a developer not included in the cartridge 300 (a small particle developer removed via a manufacturing process).

The wax heat quantity of a classified product is determined based on an amount of wax added. The amount of wax of the fine powder of the developer generated during a classifying process of the developer is affected by the wax dispersion state of the developer. In other words, when the wax dispersion coefficient is large, a large amount of wax is adhered to the developer before grinding. In a grinding process of the developer, the developer is easily grinded with wax adhered to the developer as an interface. Thus, a proportion of the wax included in the classified fine powder is increased, and the wax dispersion coefficient is increased.

FIG. 7 is a diagram showing an example of a relationship between control information and a temperature of the developing device 132 for each dispersion coefficient. The wax dispersion coefficient is classified into dispersion coefficient "small", dispersion coefficient "normal", and dispersion coefficient "large". The number of categories of the dispersion coefficient may be increased or decreased as required. When the wax dispersion coefficient is, for example, in a range of 1.0 to 2.0, the wax dispersion coefficient is small. When the wax dispersion coefficient is, for example, in a range of 2.1 to 3.0, the wax dispersion coefficient is normal (ordinary). When the wax dispersion coefficient is equal to or higher than 3.1, the wax dispersion coefficient is large. Any one of the pieces of control information "1" to "4" may be recorded on the memory 301 for each wax dispersion coefficient.

The control unit 160 selects control information associated with a temperature of the developing device 132 from among a plurality of pieces of control information stored in the memory 170. For example, when each piece of control information of the wax dispersion coefficient "dispersion coefficient (large)" is stored in the memory 170 and the temperature of the developing device 132 belongs to a first temperature category, the control unit 160 selects the control information "1" associated with the first temperature category. The control unit 160 controls an operation of the developing device 132 based on the control information. When the control information "1" is selected, the control unit 160 performs a print job without having to stop the performing of the print job.

As described above, in the second embodiment, one or more pieces of control information pre-associated with a measurement value are determined for each wax dispersion coefficient of the developer. Accordingly, it is possible to prevent a time during which a printing operation is limited from increasing longer than necessary, based on a dispersion coefficient of the wax in the developer.

Third Embodiment

A third embodiment is different from the first embodiment and the second embodiment in that temperature category and control information are associated with each glass transition temperature of the developer. In the third embodiment, differences from the first embodiment and the second embodiment will be described.

Figure 8:
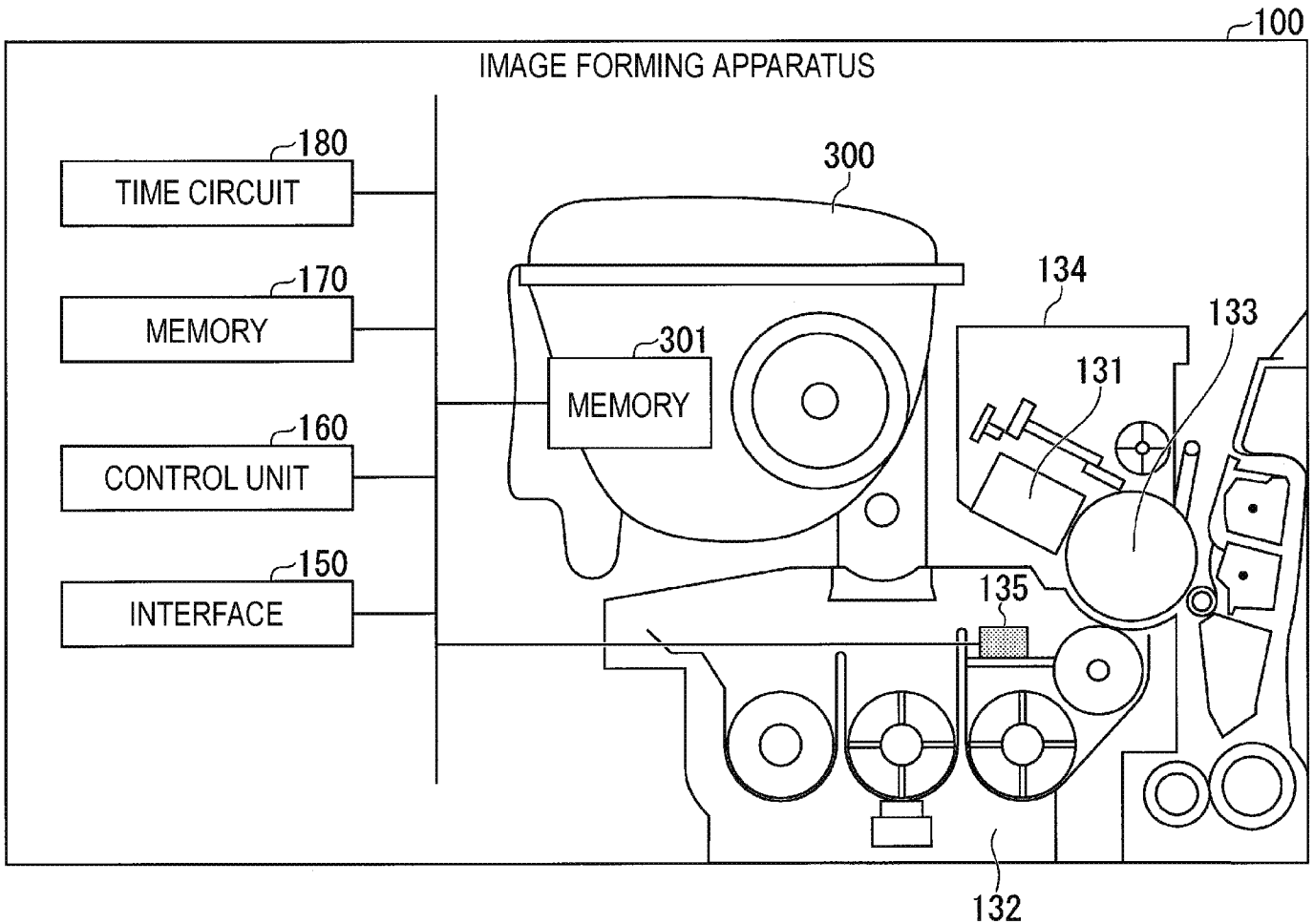
FIG. 8 is an external view showing an overall configuration example of an image forming apparatus according to a third embodiment.

FIG. 8 is an external view showing an overall configuration example of the image forming apparatus 100. The image forming apparatus 100 includes the charging device 131, the developing device 132, the photosensitive drum 133, the cleaning device 134, and the sensor 135 as the printer 130. The image forming apparatus 100 includes the interface 150, the control unit 160, the memory 170, and a time circuit 180. The memory 170 may store calendar information. The time circuit 180 generates current time information (calendar information).

FIG. 9 is a diagram showing an arrangement example of information in the memory 170 of the image forming apparatus 100. In FIG. 9, a plurality of addresses from "A001" to "A007" is defined in the memory 170. Predetermined identification information is stored in the address "A001". Manufacturing date information of a developer of the cartridge 300 is stored in the address "A002". Control information (operation specification information) stored in the memory 301 is stored in the plurality of addresses from "A003" to "A007" for each temperature category. The interface 150 records each piece of control information and the manufacturing date information stored in the memory 301, on the memory 170 in response to control by the control unit 160 when power on or the like of the image forming apparatus 100 is detected.

FIG. 10 is a diagram showing an arrangement example of information in the memory 301 of the cartridge 300. In FIG. 10, a plurality of addresses from "B001" to "B007" is defined in the memory 301. In the address "B001", the same identification information as the identification information stored in the memory 170 is stored. In the address "B002", manufacturing date information stored in the memory 170 is stored. In the plurality of addresses from "B003" to "B007", control information is stored for each temperature category. Each piece of control information is pre-determined based on a glass transition temperature of a developer of the cartridge 300, as operation specification information corresponding to a detected temperature. The glass transition temperature of the developer is measured for each production lot of the cartridge 300.

The glass transition temperature is classified into a glass transition temperature "low", a glass transition temperature "normal", and a glass transition temperature "high". The number of categories of the glass transition temperature may be increased or decreased as required. When the glass transition temperature is, for example, in a range of 30.0 to 34.0° C., the glass transition temperature is low. When the glass transition temperature is, for example, in a range of 34.1 to 40.0° C., the glass transition temperature is normal (ordinary). When the glass transition temperature is, for example, in a range of 40.1 to 45.0° C., the glass transition temperature is high. Any one of the pieces of control information "1" to "4" is recorded on the memory 301 for each glass transition temperature.

When a glass transition temperature "Tg" of the developer is high, a transport characteristic of the developer is hardly affected by heat. In a curve of a graph in which a vertical axis denotes a heat value [W/g] of the developer and a horizontal axis denotes a temperature [° C.] of the developer, an inflection point may occur in a temperature range of 25 to 50° C. An intersection of a tangent of the inflection point and a base line of the heat value of the developer indicates the glass transition temperature "Tg" of the developer.

Figures 11, 12:
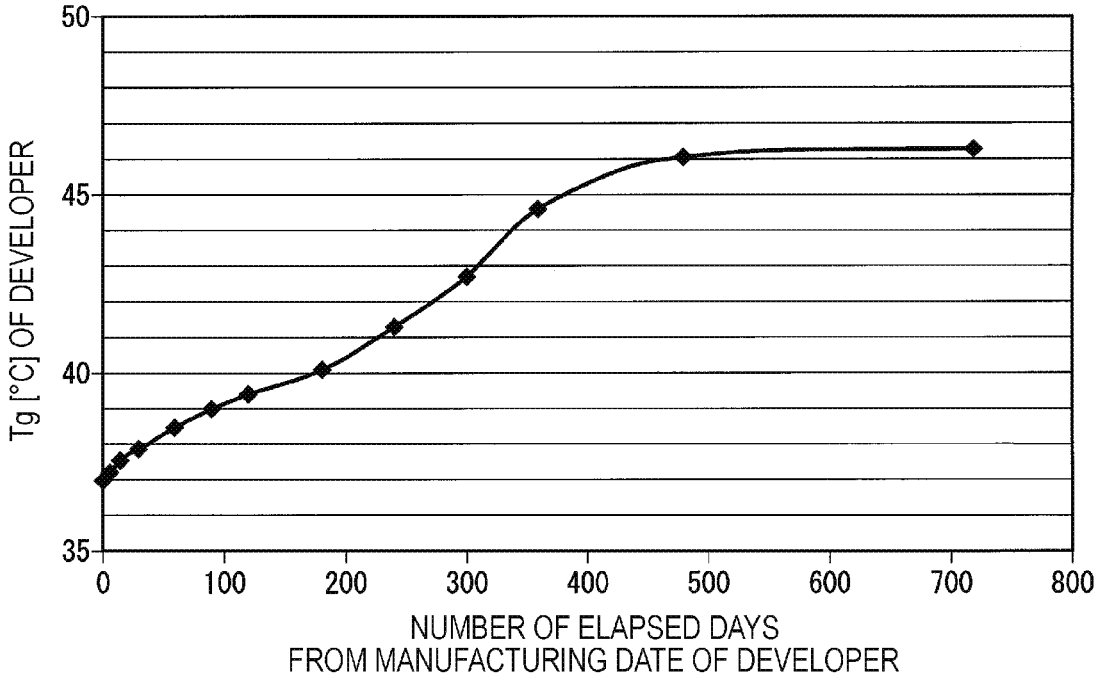
FIG. 11 is a diagram showing an example of a change in a glass transition temperature of a developer.
FIG. 12 is a diagram showing an example of a relationship between control information and a temperature category of a developing device for each range of the glass transition temperature of the developer.

FIG. 11 is a diagram showing an example of a change in a glass transition temperature of a developer. A horizontal axis denotes an elapsed time from a manufacturing date of the developer. A vertical axis denotes a glass transition temperature "Tg" of the developer. The glass transition temperature of the developer increases by about 3° C. when 180 days have passed since the manufacturing date of the developer. The glass transition temperature of the developer increases by about 6° C. when 300 days have passed since the manufacturing date of the developer. The glass transition temperature of the developer increases by about 9° C. when 480 days have passed since the manufacturing date of the developer. A thermal characteristic of the developer is stabilized when more than 480 days have passed since the manufacturing date of the developer. The glass transition temperature of the developer does not increase noticeably when more than 480 days have passed from the manufacturing date of the developer. As such, since the glass transition temperature of the developer increases as time passes from the manufacturing date of the developer, the possibility of transport failure of the developer occurring based on the temperature of the developing device 132 is decreased.

FIG. 12 is a diagram showing an example of a relationship between control information and a temperature category of the developing device 132 for each range of a glass transition temperature of a developer. A data table shown in FIG. 12 is stored in the memory 170. The control unit 160 selects control information associated with a temperature of the developing device 132 from among a plurality of pieces of control information stored in the memory 170. For example, when each piece of control information of a glass transition temperature "Tg (high)" is stored in the memory 170 and the temperature of the developing device 132 belongs to a first temperature category, the control unit 160 selects control information "1" associated with the first temperature category. The control unit 160 controls an operation of the developing device 132 based on the control information. When the control information "1" is selected, the control unit 160 performs a print job without having to stop the performing of the print job.

Since the glass transition temperature of the developer increases according to an elapsed time from the manufacturing date of the developer, the control unit 160 may change a result of selecting the control information based on the elapsed time (the number of elapsed days) from the manufacturing date of the developer.

Figures 13, 14:
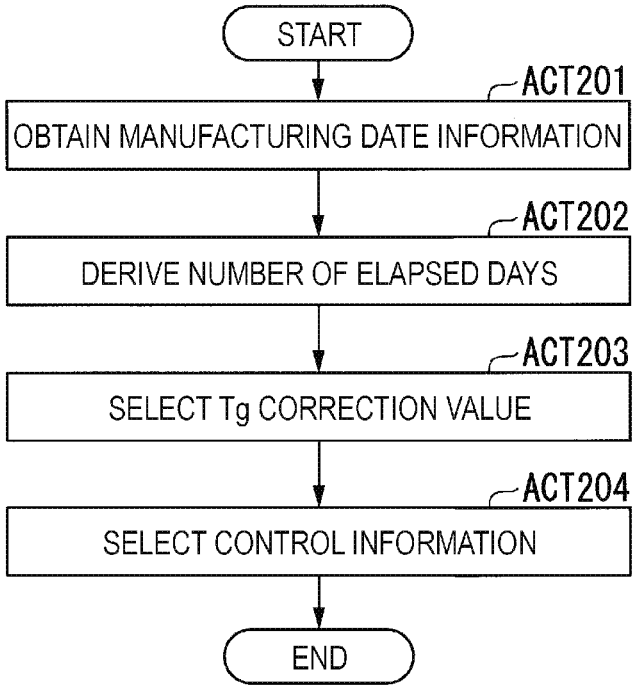
FIG. 13 is a diagram showing a Tg correction value for each elapsed day category.
FIG. 14 is a flowchart of an operation example of the image forming apparatus.

FIG. 13 is a diagram showing a correction value of a glass transition temperature (hereinafter, referred to as a "Tg correction value") for each elapsed day category. A data table shown in FIG. 13 is stored in the memory 170. A first elapsed day category is a day category in which the number of elapsed days is, for example, in a range of 0 to 180 days. A second elapsed day category is a day category in which the number of elapsed days is, for example, in a range of 181 to 300 days. A third elapsed day category is a day category in which the number of elapsed days is, for example, 301 days or more. The number of elapsed day categories may be increased or decreased as required.

The glass transition temperature of the developer increases by about 3° C. from a point of time when 180 days have passed since the manufacturing date, but the first elapsed day category is associated with a Tg correction value "0° C.", which is based on the glass transition temperature at a point of time when 0 days have passed since the manufacturing date. The glass transition temperature of the developer increases by about 6° C. from a point of time when 300 days have passed since the manufacturing date, but the second elapsed day category is associated with a Tg correction value "+3° C.", which is based on the glass transition temperature at a point of time when 181 days have passed since the manufacturing date. The glass transition temperature of the developer increases by about 9° C. from a point of time when 480 days have passed since the manufacturing date, but the third elapsed day category is associated with a Tg correction value "+5° C.", which is based on the glass transition temperature at a point of time when 301 days have passed since the manufacturing date.

As shown in FIG. 13, since there is a width in categories of the glass transition temperature, an increasing value of the glass transition temperature and the Tg correction value may not completely match each other.

The control unit 160 derives the elapsed time (the number of elapsed days) from the manufacturing date of the developer, based on manufacturing date information stored in the memory 170 and time information generated by the time circuit 180. The control unit 160 may update information of the derived elapsed time at a predetermined cycle. The control unit 160 selects the Tg correction value according to the number of elapsed days from the manufacturing date of the developer. The control unit 160 adds the selected Tg correction value to a temperature range of the glass transition temperature of the data table shown in FIG. 12.

When the number of elapsed days belongs to the first elapsed day category, the control unit 160 selects the Tg correction value "0° C." associated with the first elapsed day category. When the Tg correction value "0° C." is selected, the control unit 160 may not correct the temperature range of the glass transition temperature "Tg" of the data table shown in FIG. 12.

When the number of elapsed days belongs to the second elapsed day category, the control unit 160 selects the Tg correction value "+3° C." associated with the second elapsed day category. When the Tg correction value "+3° C." is selected, the control unit 160 adds 3° C. to the temperature range of the glass transition temperature "Tg" of the data table shown in FIG. 12. In other words, the control unit 160 rewrites, for example, each piece of control information of the glass transition temperature "Tg (low)" stored in the memory 170 to, for example, each piece of control information of the glass transition temperature "Tg (normal)".

Next, an operation example of the image forming apparatus 100 will be described.

FIG. 14 is a flowchart of an operation example of the image forming apparatus 100. Operations shown in the flowchart of FIG. 14 are details of an operation of ACT 106 shown in the flowchart of FIG. 6. The control unit 160 obtains a result of detecting a temperature of the developing device 132. The control unit 160 obtains manufacturing date information stored in the memory 170 (ACT 201). The control unit 160 derives the number of elapsed days from a manufacturing date of the developer, based on the manufacturing date information (ACT 202). The control unit 160 selects a Tg correction value based on the number of elapsed days (ACT 203). The control unit 160 selects control information based on a temperature of the developing device 132. The control unit 160 may change a result of selecting the control information according to the Tg correction value (ACT 204).

As described above, in the third embodiment, the memory 301 stores at least one of a particle size distribution, a volume average particle size, a storage characteristic, adhesive strength with an external additive, a glass transition temperature, and an amount or dispersion coefficient of wax of the developer in association with a measurement value of the developer in advance. Control information of the developing device 132 is determined based on at least one of the particle size distribution, the volume average particle size, the storage characteristic, the adhesive strength with the external additive, the glass transition temperature, and the amount or dispersion coefficient of wax of the developer. The memory 301 may store information of a manufacturing date of the developer. The control unit 160 changes a result of selecting the control information based on an elapsed time from the manufacturing date of the developer. The control unit 160 controls an operation of the developing device 132 based on the changed control information. Accordingly, it is possible to prevent a time during which a printing operation is limited from being increased longer than necessary, based on a glass transition temperature of the developer. It is possible to select the control information with high accuracy according to the elapsed time from the manufacturing date of the developer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a developing device configured to form an image on an image carrier by using a developer;

a sensor configured to generate a signal indicating a temperature related to the developer;

a control information obtaining unit configured to:

obtain, as control information of the developing device, one or more pieces of the control information pre-associated with the temperature and determined based on an amount or dispersion coefficient of wax of the developer, from a recording medium associated with the developer; and obtain, from the recording medium, information related to (a) a manufacturing date of the developer and (b) a correction value of the control information related to an elapsed time from the manufacturing date; and a control unit configured to:

select the control information associated with the temperature indicated by the signal, from the one or more pieces of control information obtained from the recording medium;

change the selected control information based on the correction value and the elapsed time from the manufacturing date; and control an operation of the developing device based on the changed control information.

2. The image forming apparatus of claim 1, wherein the one or more pieces of control information associated with the measurement value are further determined based on at least one of a particle size distribution, a volume average particle size, a storage characteristic, an adhesion strength with an external additive, and a glass transition temperature.

3. The image forming apparatus of claim 2, wherein the one or more pieces of control information associated with the measurement value are determined based on the particle size distribution.

4. The image forming apparatus of claim 2, wherein the one or more pieces of control information associated with the measurement value are determined based on the glass transition temperature.

5. The image forming apparatus of claim 1, wherein the recording medium is provided at a developer container attachable to and detachable from the image forming apparatus.

6. The image forming apparatus of claim 1, wherein controlling the operation of the developing device based on the changed control information includes at least one of:

performing a print job;

reversing a rotation direction of a roller configured to convey the developer within the developing device;

varying a rotation speed of the roller; and stopping performing of a print job.

7. The image forming apparatus of claim 6, wherein controlling the operation of the developing device based on the changed control information includes lowering the rotation speed of the roller until a temperature of the developing device has decreased to a predetermined temperature.

8. The image forming apparatus of claim 6, wherein controlling the operation of the developing device based on the changed control information includes stopping performing of a print job.

9. The image forming apparatus of claim 1, wherein the control unit is configured to determine whether identification information stored in a memory of the image forming apparatus matches identification information stored in the recording medium, and wherein the control unit is configured to control an operation of the developing device irrespective of the one or more pieces of control information in response to a determination that the identification information stored in the memory of the image forming apparatus does not match the identification information stored in the recording medium.

10. A method of operating an image forming apparatus, comprising:

determining, by a sensor, a temperature associated with a developing device of the image forming apparatus;

obtaining, by a control unit, one or more pieces of control information determined based on an amount or dispersion coefficient of wax of a developer used by the developing device;

selecting, by the control unit, control information from the one or more pieces of control information based on the temperature determined by the sensor;

obtaining, by the control unit, information related to (a) a manufacturing date of the developer and (b) a correction value of the control information related to an elapsed time from the manufacturing date;

changing, by the control unit, the selected control information based on the correction value and the elapsed time from the manufacturing date;

controlling, by the control unit, the developing device to perform a print job in response to the changed control information including first control information; and controlling, by the control unit, the developing device to stop performing a print job in response to the changed control information including second control information.

11. The method of claim 10, wherein obtaining, by the control unit, one or more pieces of control information includes obtaining control information from a recording medium associated with the developer.

12. The method of claim 11, wherein the recording medium is provided at a developer container attachable to and detachable from the image forming apparatus.

13. The method of claim 11, further comprising:

determining, by the control unit, whether identification information stored in a memory of the image forming apparatus matches identification information stored in the recording medium;

controlling, by the control unit, the developing device based on the one or more pieces of control information in response to a determination that the identification information stored in the memory of the image forming apparatus matches the identification information stored in the recording medium; and controlling, by the control unit, the developing device irrespective of the one or more pieces of control information in response to a determination that the identification information stored in the memory of the image forming apparatus does not match the identification information stored in the recording medium.

* * * * *